US005483796A

United States Patent [19]

Ando

[11] Patent Number: 5,483,796

[45] Date of Patent: Jan. 16, 1996

[54] FLUID CYLINDER

[75] Inventor: Etuo Ando, Tokyo, Japan

[73] Assignee: Ando Seisakujo Co., Ltd., Tokyo, Japan

[21] Appl. No.: 420,556

[22] Filed: Apr. 12, 1995

[30] Foreign Application Priority Data

Feb. 3, 1995 [JP] Japan ..... 7-039363

[51] Int. Cl.[6] ..... F15B 7/00

[52] U.S. Cl. ..... 60/560; 60/563; 60/571; 92/62; 92/65

[58] Field of Search ..... 92/62, 65, 69 R, 92/50, 75; 60/547.1, 563, 571, 560

[56] References Cited

U.S. PATENT DOCUMENTS

| | | | |
|---|---|---|---|
| 4,149,384 | 4/1979 | Marshall | 60/560 |
| 4,296,679 | 10/1981 | Mattsson | 92/65 |
| 4,620,419 | 11/1986 | Simson | 60/560 |
| 4,993,226 | 2/1991 | De Kok | 60/563 |
| 5,188,014 | 2/1993 | Simson | 92/65 |
| 5,297,382 | 3/1994 | Waltonen et al. | 92/62 |

FOREIGN PATENT DOCUMENTS

| | | | |
|---|---|---|---|
| 21376 | 2/1978 | Japan | 60/563 |

*Primary Examiner*—Thomas E. Denion

*Attorney, Agent, or Firm*—Griffin, Butler, Whisenhunt & Kurtossy

[57] ABSTRACT

A second pressure intensifying cylinder subchamber is employed for moving a pressure intensifying piston toward the other side, and the necessity for a control valve with a throttle is thereby eliminated. The pressure intensifying piston is incorporated integrally into a fluid cylinder, and, hence, the fluid cylinder can be installed in an even narrow space. A main cylinder chamber communicates with a pressure intensifying cylinder chamber in the interior of the fluid cylinder, and it is therefore possible to prevent such a situation that a high-pressure fluid sprouts out. A structure of the fluid cylinder is thus simplified enough to reduce the costs, and the safety is improved.

4 Claims, 4 Drawing Sheets

FLUID CYLINDER

BACKGROUND OF THE INVENTION

1. Field of the Invention

The present invention relates to a fluid cylinder capable of moving a main piston by a large fluid force when starting a backward movement.

2. Related Background Art

In general, a fluid cylinder for a die of a die cast machine, an injection machine, etc. works to simply move the die when a piston moves forward (when a piston rod is protruded) and therefore requires no large driving force. When the piston starts moving backward (when starting a retraction of the piston rod), however, there is a necessity for taking off the die from a product in the course of being cooled off. A large driving force is therefore needed.

For this reason, according to the prior art, a pressure intensifying cylinder is interposed between the die-oriented fluid cylinder, a fluid source and a tank, and a fluid discharged out of the fluid source is supplied to the pressure intensifying cylinder. The pressure intensifying piston of the pressure intensifying cylinder is moved toward one side to push out a high-pressure fluid. At the same time, a large force given by this high-pressure fluid pushed out acts to move the piston of the fluid cylinder toward a pull-in side, thus taking off the die from the product. Thereafter, when the pressure intensifying piston moves to a one-side limit, the fluid discharged from the fluid source is supplied to the fluid cylinder via a bypass, and the piston of the fluid cylinder is moved up to a pull-in limit. Next, when the piston of the above-described fluid cylinder is returned to a protrusion limit, the fluid discharged out of the fluid source is supplied to the fluid cylinder to move the piston toward the protrusion side. At the same time, the return fluid flowing out of the fluid cylinder is guided to the pressure intensifying cylinder, thereby moving the pressure intensifying piston toward the other side. At this time, however, a control valve with a throttle that is provided midway of the bypass is opened, and a flow of the return fluid is regulated by the throttle. The return fluid is thereby guided, at first, to the pressure intensifying cylinder, and the pressure intensifying piston is moved up to the other-side limit. Thereafter, the control valve is opened, and the remaining return fluid is returned via the bypass to the tank.

There arise, however, the following problems inherent in the above-explained prior art. The control valve with the throttle is required for determining whether the return fluid should be guided to the pressure intensifying cylinder or allowed to pass through the bypass. The structure is therefore complicated, and, at the same time, the costs increase. Besides, the pressure intensifying cylinder is installed in addition to the fluid cylinder, and, therefore, a large installation space is needed. At the same time, if a pipe for connecting this fluid cylinder to the pressure intensifying cylinder is broken, the high-pressure fluid sprouts out of this broken portion.

SUMMARY OF THE INVENTION

It is a primary object of the present invention to provide a fluid cylinder capable of simplifying a structure, attaining both down-sizing and a reduction in costs and ensuring safety.

To accomplish this object, according to one aspect of the present invention, there is provided a fluid cylinder comprising: a cylinder casing having its interior formed with a main cylinder chamber and a pressure intensifying cylinder chamber; a main piston, slidably housed in the main cylinder chamber and provided with a piston rod linked to a load on its front edge side, for sectioning the main cylinder chamber into a front main cylinder subchamber positioned on the front side and a rear main cylinder subchamber positioned on the rear side; a front supply/discharge path, formed within the cylinder casing, for supplying a fluid to the front main cylinder subchamber; a rear supply/discharge path, formed within the cylinder casing, for supplying the fluid to the rear main cylinder subchamber; and a pressure intensifying piston, slidably housed in the pressure intensifying cylinder chamber, for sectioning the pressure intensifying cylinder chamber into first and second pressure intensifying cylinder subchambers positioned on one side but shut off from each other in terms of a fluidity and an other-side pressure intensifying cylinder subchamber positioned on the other side. The first pressure intensifying cylinder subchamber is connected to the front main cylinder subchamber. The second pressure intensifying cylinder subchamber is connected to the rear supply/discharge path. The other-side pressure intensifying cylinder subchamber is connected to the front supply/discharge path. A large fluid force acting backward is imparted to the main piston by guiding a high pressure generated in the first pressure intensifying cylinder subchamber to the front main cylinder subchamber with a movement of the pressure intensifying piston toward one side when the fluid is supplied from the front supply/discharge path to the other-side pressure intensifying cylinder subchamber. The pressure intensifying piston is, on the other hand, moved up to an other-side limit in advance of the main piston when the fluid is supplied from the rear supply/discharge path to the rear main cylinder subchamber and the second pressure intensifying cylinder subchamber.

Now, it is assumed that the main piston is positioned in the front limit, while the pressure intensifying piston is positioned at the other side edge. Next, when the fluid is supplied to the other-side pressure intensifying cylinder subchamber of the pressure intensifying cylinder chamber via the front supply/discharge path, the pressure intensifying piston undergoes a fluid force and is thereby moved toward one side. A high pressure is thereby generated in the first pressure intensifying cylinder subchamber. Then, the high pressure generated in this first pressure intensifying cylinder subchamber is guided to the front main cylinder, and the large fluid force acting backward is imparted to the main piston. As a result, the main piston is moved backward by this large fluid force. If the fluid cylinder is a die-oriented fluid cylinder of a die cast machine, an injection machine, etc., the die is strongly surely taken off from the product. At this time, the fluid flowing out of the second pressure intensifying cylinder subchamber and the rear main cylinder subchamber is discharged via the rear supply/discharge path. Next, when the pressure intensifying piston moves up to one-side limit and stops moving, the main piston is further moved backward by the fluid force of the fluid supplied to the front main cylinder subchamber via the front supply/discharge path. Then, when the main piston moves up to the rear edge, the supply of the fluid via the front supply/discharge path is stopped. Next, when the rear main cylinder subchamber and the second pressure intensifying cylinder subchamber are supplied with the fluid via the rear supply/discharge path, the fluid force acting forward is given to the main piston, while the fluid force acting on the other side is given to the pressure intensifying piston. At this time, a load, e.g., the above die is linked to the main piston. The pressure intensifying piston is not, however, linked to any load and hence moves toward the other side in advance of the main piston. At this moment, a part of the fluid flowing out of the other-side pressure intensifying cylinder subchamber runs into the first pressure intensifying cylinder subchamber via the front supply/discharge path and the front main cylinder subchamber. The rest of the fluid is discharged via the front supply/discharge path. Subsequently, when this pressure intensifying piston moves up to the other-side limit, the main piston starts moving forward. Thereafter, this pressure intensifying piston moves up to the front limit and then stops moving. At this time, however, the fluid flowing out of the front main cylinder subchamber is discharged via the front supply/discharge path. As discussed above, the second pressure intensifying cylinder subchamber that is not normally used is employed for moving the pressure intensifying piston toward the other side. Hence, there is eliminated the necessity for the control valve with the throttle as seen in the prior art, and it is possible to simplify the structure and reduce the manufacturing costs. Further, since the pressure intensifying piston is incorporated integrally into the fluid cylinder, the fluid cylinder can be installed in even a narrow space. Besides, the main cylinder chamber and the pressure intensifying cylinder chamber are connected to each other in the interior of the fluid cylinder, and, therefore, it does not happen that the high-pressure fluid easily sprouts out, resulting in the assurance of the safety.

Based further on the construction according to claim 2, the down-sizing of the fluid cylinder is attainable.

Based still further on the construction according to claim 3, the passageway through which the first pressure intensifying cylinder subchamber communicates with the front main cylinder subchamber is easy to form.

Based yet further on the construction according to claim 4, there is no necessity for a mechanical element, e.g., a wedge member for regulating the movement of the main piston.

BRIEF DESCRIPTION OF THE DRAWINGS

Other objects and advantages of the present invention will become apparent during the following discussion in conjunction with the accompanying drawings, in which.

DETAILED DESCRIPTION OF THE PREFERRED EMBODIMENT

One embodiment of the present invention will hereinafter be described with reference to the accompanying drawings.

Figure 1:
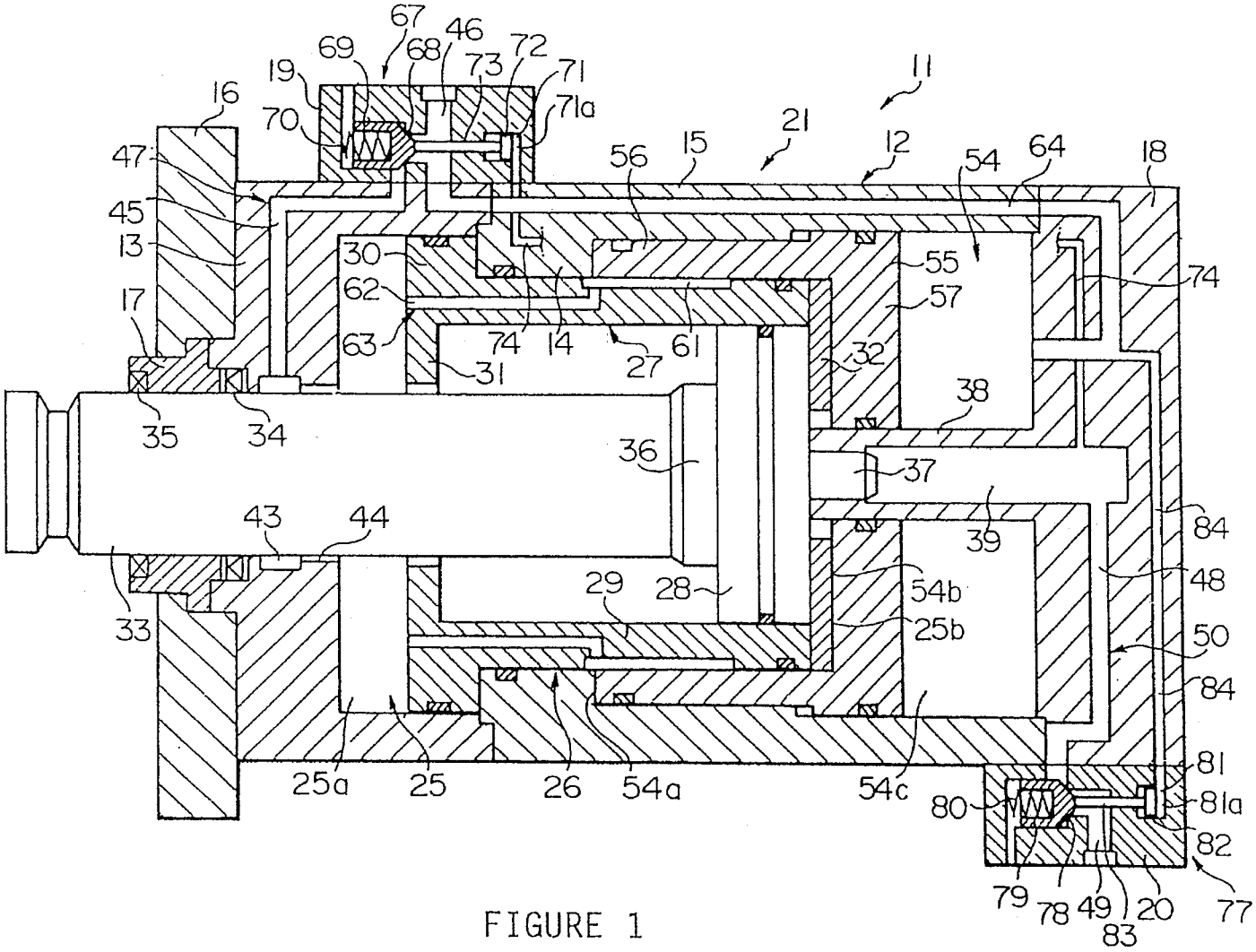
FIG. 1 is a front sectional view illustrating one embodiment of the present invention.

Referring first to FIG. 1, the numeral 11 designates a fluid cylinder for a die of a die cast machine, an injection machine, etc. This fluid cylinder 11 has a cylinder tube 12 taking a substantially cylindrical shape. This cylinder tube 12 comprises a first cylinder tube 12 assuming such a bottomed cylindrical configuration that a bottom portion is formed in a front edge thereof. The cylinder tube 12 also comprises a second cylinder tube 15 coaxial with the first cylinder tube 13 and connected to the rear edge of the first cylinder tube 13, the second cylinder tube 15 including a ring-like protrusion 14 formed along the internal periphery of the front edge portion. The numerals 16, 17 represent a front cover and a sleeve that are connected to the front edge of the cylinder tube 12, specifically, of the first cylinder 13. Designated at 18 is a rear cover, fixed to the rear edge of the cylinder tube 12, specifically, of the second cylinder tube 15, for closing an opening formed at the rear edge of the cylinder tube 12. Further, a front block 19 is fixed to the outer periphery of the front edge of the cylinder tube 12, and, at the same time, a rear block 20 is fixed to the outer periphery of the rear cover 18 as well as to the outer periphery of the rear edge of the cylinder tube 12. A cylinder casing of the fluid cylinder 11 is, on the whole, constructed of the cylinder tube 12, the front cover 16, the sleeve 17, the rear cover 18 and the front and rear blocks 19, 20.

A main cylinder chamber 25 is formed on the front side within the interior of the cylinder casing 21. A main piston 26 is slidably housed in this main cylinder chamber 25. Thus, the main cylinder chamber 25 is sectioned by the main piston 26 into a front main cylinder subchamber **25*a* positioned on the front side and a rear main cylinder subchamber 25*b* positioned on the rear side. The main piston 26 is constructed of a large-diameter piston 27 and a small-diameter piston 28 slidably housed in the large-diameter piston 27. The large-diameter piston 27 has a substantially cylindrical piston body 29. The outer periphery of the front edge of this piston body 29 is formed with a ring-like protrusion 30 capable of impinging on the front edge surface of the protrusion 14. Further, a ring-like stopper 31 is formed on the inner periphery of the front edge portion of this piston body 29. A stopper 32 takes a ring-like shape having substantially the same minor diameter as that of the stopper 31. A radial outer portion of this stopper 32 is fixed to the rear edge of the piston body 29. As a result, a radial-inner portion of the stopper 32 is protruded from the inner periphery of the piston body 29 toward the radial inner portion. The above piston body 29 and the stopper 32 are combined to constitute the large-diameter piston 27 on the whole. On the other hand, a major diameter of the small-diameter piston 28 is the same as the minor diameter of the piston body 29. Besides, an axial length of the small-diameter piston 28 is well shorter than a distance between the stoppers 31, 32. As a result, the small-diameter piston 28 is capable of moving between the stoppers 31, 32 within the large-diameter piston 27. Further, a cylindrical piston rod 33 extending toward the front edge is integrally provided on the front edge surface of the small-diameter piston 28. This piston rod 33 is slidably inserted into the sleeve 17 and a bottom portion of the first cylinder tube 13 and, at the same time, loosely fitted into the stopper 31. Besides, a load such as a die or the like is linked to the front edge of the piston rod 33. Note that the numerals 34, 35 designate a U-packing and an oil seal that are attached to the sleeve 17 and serve to seal a space between the inner periphery of the sleeve 17 and the outer periphery of the piston rod 33. The rear edge portion of the piston rod 33 is formed with a damper portion 36 having a major diameter slightly smaller than the minor diameter of the stopper 31. This damper portion 36 works, when the small-diameter piston 28 moves up to a position in close proximity to a forward limit and intruded into the stopper 31, to decelerate a forward movement of the small-diameter piston 28 by regulating a quantity of a fluid flowing between the front main cylinder subchamber 25*a* and the interior of the large-diameter piston 27, the subchamber 25*a* being positioned between the first cylinder tube 13 and the piston body 29. Further, a cylindrical damper member 37 is fixed to the other edge surface of the small-diameter piston 28. A major diameter of this damper member 37 is slightly smaller than a minor diameter of a damper passageway 39 formed within a damper rod 38 protruding forward from the front edge surface of the rear cover 18. As a result, when the small-diameter piston 28 moves up to a position in the vicinity of a backward limit and is intruded into the damper passageway 39, the quantity of the fluid flowing between the damper passageway 39 and the rear main cylinder subchamber 25***b* is regulated, thereby decelerating the backward movement of the small-diameter piston 28.

An annular groove 43 is formed in the inner periphery of the bottom portion of the first cylinder tube 13. This annular groove 43 communicates with the front main cylinder subchamber 25*a* via a narrow annular passageway 44 formed between the inner periphery of the bottom portion of the first cylinder tube 13 and the piton rod 33. Also, one end of a first front supply/discharge path 45 formed within the fist cylinder tube 13 is connected to the annular groove 43. The other end of the first front supply/discharge path 45 is connected to one end of a second front supply/discharge path 46 formed within the front block 19. The above-mentioned annular groove 43, the annular passageway 44 and the first and second front supply/discharge paths 45, 46 are combined to constitute, on the whole, a front supply/discharge path 47, formed within the cylinder casing 21, for supplying and discharging the fluid to and from the front main cylinder subchamber 25*a*. A first rear supply/discharge path 48 is formed within the rear cover 18, and one end of this path 48 is connected to the damper passageway 39. The other end of the first rear supply/discharge path 48 is connected to one end of a second rear supply/discharge path 49 formed within the rear block 20. The abovedescribed first and second rear supply/discharge paths 48, 49 are, on the whole, combined to constitute a rear supply/discharge path 50, formed within the cylinder casing 21, for supplying and discharging the fluid to and from the rear main cylinder subchamber 25*b*. Then, these front and rear supply/discharge paths 47, 50 are connected to a fluid source and a tank via an unillustrated switching valve.

A pressure intensifying cylinder chamber 54 is formed within the cylinder casing 21. A pressure intensifying piston 55 is slidably housed in this pressure intensifying cylinder chamber 54. This pressure intensifying piston 55 comprises a cylindrical portion 56 coaxial with the large-diameter piston 27 and a disc member 57 having its outer periphery integrally connected to the inner periphery of one edge portion (rear edge portion) of this cylindrical portion 56. Then, the cylindrical portion 56 of this pressure intensifying piston 55 is slidably fitted in a direct contact state to the main piston 26, specifically, to the outer portion of the large-diameter piston 27. In consequence, there does not exist any member, e.g., even a part of the cylinder casing 21 between the cylindrical portion 56 of the pressure intensifying piston 55 and the large-diameter piston 27 of the main piston 26. A structure of the fluid cylinder 11 is thereby simplified enough to attain down-sizing. Then, the pressure intensifying chamber 54 positioned on one side, herein, on the front side from the pressure intensifying piston 55 is sectioned into a first pressure intensifying cylinder subchamber 54*a* disposed in a face-to-face position with one edge surface (front edge surface) of the cylindrical portion 56 and a second pressure intensifying cylinder subchamber 54*b* disposed in a face-to-face position with one edge surface (front edge surface) of the disc member 57. These first and second pressure intensifying cylinder subchambers 54*a*, 54*b* are shut off from each other in terms of a fluidity by the large-diameter piston 27 and the cylindrical portion 56 of the pressure intensifying pistol 55. Herein, the second pressure intensifying cylinder subchamber 54*b* is connected directly (with no existence of any passageway) to the rear main cylinder subchamber 25*b*. On the other hand, the pressure intensifying cylinder chamber 54 positioned on the other side, herein, on the rear side from the pressure intensifying piston 55 constitutes an other-side pressure intensifying cylinder subchamber 54*c*. This other-side pressure intensifying cylinder subchamber 54*c* is, however, disposed in a face-to-face position with the other edge surfaces (rear edge surfaces) of both of the cylindrical portion 56 and the disc member 57 and therefore has a pressure receiving area larger than that of each of the first and second pressure intensifying cylinder subchambers 54*a*, 54*b*.

A shallow circumferential groove 61 is formed in the main piston 26, specifically, in the outer periphery of the rear portion of the large-diameter piston 27. One edge of a first passageway 62 is opened in the front edge surface of the large-diameter piston 27. The other edge of the first passageway 62 is opened in the bottom portion of this circumferential groove 61. The above-mentioned circumferential groove 61 and the first passageway 62, which are formed in an interior of the main piston 26, are combined to constitute, on the whole, a first connection passageway 63 serving as a passageway through which the front main cylinder subchamber 25*a* communicates with the first pressure intensifying cylinder subchamber 54*a*. When the first connection passageway 63 is thus formed in the interior of the main piston 26, the formation work is more facilitated than in the case of being formed in the interior of the cylinder casing 21, and this leads to a reduction in terms of manufacturing costs. A second connection passageway 64 formed in the interior of the cylinder casing 21 serves to communicate the second front supply/discharge path 46 with the rear pressure intensifying cylinder subchamber 54*c*.

A front opening/closing valve 67 is provided in the front supply/discharge path, specifically, midway of the second front supply/discharge path 46. This front opening/closing valve 67 includes a spool 69 for closing the second front supply/discharge path 46 halfway when seated on a valve seat 68 and a spring 70 for biasing this spool 69 toward the valve seat 68. The front opening/closing valve 67 further includes a pilot piston 72 slidably housed in a pilot cylinder chamber 71 formed within the front block 19 and a pilot rod 73 capable of impinging on the spool 69 linked to the pilot piston 72. Further, a head-side subchamber 71*a* of the pilot cylinder chamber 71 is connected to the rear supply/discharge path 50 via the damper passageway 39 and the front pilot passageway 74 formed within the cylinder casing 21. As a result, when the fluid having a set pressure is supplied to the head-side subchamber 71*a* via the rear supply/discharge path 50, the pilot piston 72 moves forward to separate the spool 69 from the valve seat 68, thereby opening the front opening/closing valve 67. Also, when the fluid having the set pressure is supplied to the front supply/discharge path 47, the spool 69 is, upon receiving this fluid pressure, separated from the valve seat 68, thereby opening the front opening/closing valve 67. The above-mentioned spool 69, the spring 70, the pilot piston 72 and the pilot rod 73, which are provided in the front block 19, are combined to constitute, on the whole, the above front opening/closing valve 67 that is, when the front supply/discharge path 47 or the rear supply/discharge path 50 is under a set pressure, opened upon receiving this set pressure but closed when both of the front and rear supply/discharge paths 47, 50 are under a low pressure.

A rear opening/closing valve 77 serves as an opening/closing valve provided in the rear supply/discharge path 50, specifically, halfway of the second rear supply/discharge path 49. This rear opening/closing valve 77 includes a spool 79 for closing the second front supply/discharge path 49 halfway when seated on a valve seat 78 and a spring 80 for biasing this spool 79 toward the valve seat 78. The rear opening/closing valve 77 further includes a pilot piston 82 slidably housed in a pilot cylinder chamber 81 formed within the rear block 20 and a pilot rod 83 capable of impinging on the spool 79 linked to the pilot piston 82. Further, a head-side subchamber 81*a* of the pilot cylinder chamber 81 is connected to the front supply/discharge path 47 via the second connection passageway 64 and the rear pilot passageway 84 formed within the cylinder casing 21. As a result, when the fluid having a set pressure is supplied to the head-side subchamber 81*a* via the front supply/discharge path 47, the pilot piston 82 moves forward to separate the spool 79 from the valve seat 78, thereby opening the rear opening/closing valve 77. Also, when the fluid having the set pressure is supplied to the rear supply/discharge path 50, the spool 79 is, upon receiving this fluid pressure, separated from the valve seat 78, thereby opening the rear opening/closing valve 77. The above-mentioned spool 79, the spring 80, the pilot piston 82 and the pilot rod 83, which are provided in the rear block 20, are combined to constitute, on the whole, the above rear opening/closing valve 77 that is, when the rear supply/discharge path 50 or the front supply/discharge path 47 is under a set pressure, opened upon receiving this set pressure but closed when both of the front and rear supply/discharge paths 47, 50 are under a low pressure. Then, this rear opening/closing valve 77 is, as described above, closed when both of the front and rear supply/discharge 47, 50 are under a low pressure. The rear main cylinder subchamber 25*b* is thereby locked in terms of the fluidity (a flow of the fluid is hindered), and the movement of the main piston 26 is thus regulated. In this way, the main piston 26 is locked in terms of the fluidity by the rear opening/closing valve 77. Hence, there is eliminated the necessity for a mechanical element for regulating the movement of the die when closed, e.g., a wedge member intruded into the die in the prior art. As a result, the structure is simplified, whereby the down-sizing of the apparatus can be attained.

Given next is an explanation of the operation of one embodiment of the present invention.

Figure 2:
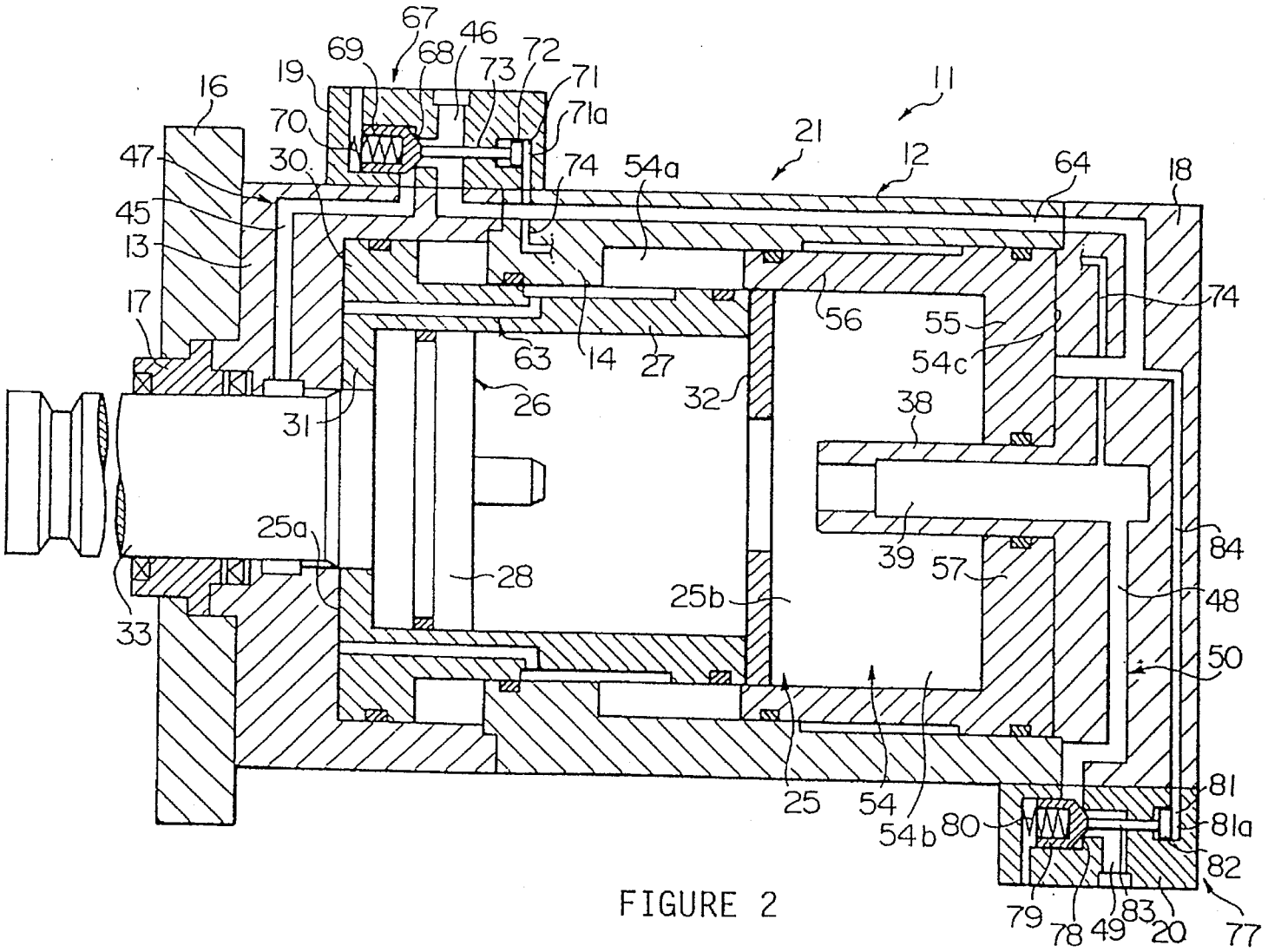
FIG. 2 is a front sectional view, similar to FIG. 1, of assistance in explaining an operating state.

Now, it is assumed that as illustrated in FIG. 2, the main piston 26 is stopped to the forward limit, specifically, stopped in such a position that the large-diameter piston 27 impinges on the bottom of the first cylinder tube 13, while the small-diameter piston 28 impinges on the stopper 31 of the large-diameter piston 27. It is also assumed that the pressure intensifying piston 55 is stopped to the other limit (backward limit), specifically stopped in such a position as to impinge on the rear cover 18. At this time, the piston rod 33 is stopped to a protrusion limit, and, hence, the die is closed. A molten metal is poured into a cavity in an interior of the die. Further, at this time, both of the front and rear supply/discharge paths 47, 50 are connected to the tank and are under a low pressure. Therefore, the spools 69, 79 are biased by the springs 70, 80 and thus pushed against the valve seats 68, 78, and the front and rear opening/closing valves 67, 77 are closed. In consequence, the front main cylinder subchamber 25*a*, the other-side pressure intensifying cylinder subchamber 54*c* and the rear main cylinder subchamber 25*b* are locked in terms of the fluidity, while the movements of the main piston 26 and the pressure intensifying piston 55 are regulated in terms of the fluidity. This eliminates the necessity for the mechanical element for regulating the movement of the die when the die is closed, e.g., the wedge member intruded into the die.

Figure 3:
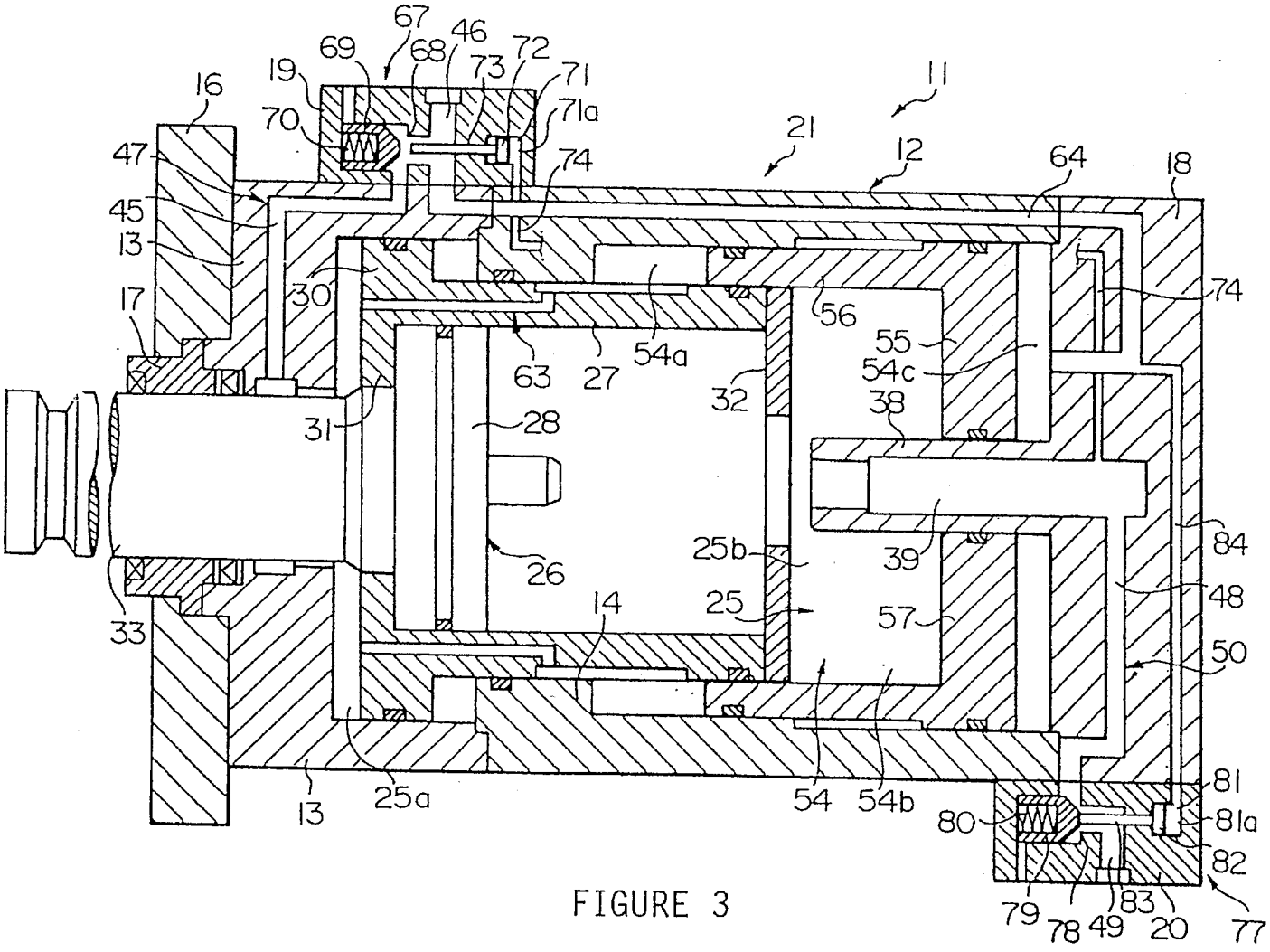
FIG. 3 is a front sectional view, similar to FIG. 1, of assistance in explaining the operating state.

Next, switching valves are switched over, thereby connecting the front supply/discharge path 47 to the fluid source and the rear supply/discharge path 50 to the tank. At this time, the set-pressure fluid discharged from the fluid source is supplied to the other-side pressure intensifying cylinder subchamber 54*c* via the front supply/discharge path 47 and the second connection passageway 64. The pressure intensifying piston 55 is moved forward by this fluid force. At this time, an area (a total of areas of the cylindrical portion 56 and of the disc member 57) of the other-side surface of the pressure intensifying piston 55 undergoing the fluid pressure within the other-side pressure intensifying cylinder subchamber 54*c* is well wider than an area (area of the cylindrical portion 56) of one-side surface of the pressure intensifying piston 55 undergoing the fluid pressure within the first pressure intensifying cylinder subchamber 54*a*. Hence, the fluid within the first pressure intensifying cylinder subchamber 54*a* is compressed to generate a pressure well higher than the set pressure. The thus generated high-pressure fluid in the first pressure intensifying cylinder subchamber 54*a* is guided via the first connection passageway 63 to the front main cylinder subchamber 25*a*, thereby imparting a large backward fluid force to the main piston 26. As a result, the large- and small-diameter pistons 27, 28 constituting the main piston 26 are pushed by the large fluid force and moved back together. The die is pulled out by the large force, thus attaining an opened state. The die is thereby strongly surely taken off from a product solidified by cooling within the die. At this time, the set-pressure fluid supplied to the front supply/discharge path 47 causes the spool 69 to move forward, thus opening the front opening/closing valve 67. Further, the fluid supplied to the head-side subchamber 81*a* of the pilot cylinder chamber 81 via the front supply/discharge path 47, the second connection passageway 64 and the rear pilot passageway 84 thrusts out the pilot piston 82 and the pilot rod 83 forward. The spool 79 is therefore intruded forward by the pilot rod 83, and the rear opening/closing valve 77 is also opened. As a result, the fluid to the damper passageway 39 from the second pressure intensifying cylinder subchamber 54*b* and the rear main cylinder subchamber 25*b* is discharged via the rear supply/discharge path 50 to the tank. FIG. 3 illustrates a state at this moment.

Next, when the pressure intensifying piston 55 moves up to the one-side limit (forward limit) with the result that the front edge of the cylindrical portion 56 impinges on the protrusion 14 of the cylinder casing 21, the pressure intensifying piston 55 stops moving. Thereafter, however, the main piston 26, i.e., the large- and small-diameter pistons 27, 28 are moved more backward by the fluid force of the set-pressure fluid supplied to the front main cylinder subchamber 25*a* via the front supply/discharge path 47. Then, when the protrusion 30 of the large-diameter piston 27 impinges on the protrusion 14 of the cylinder casing 21, this large-diameter piston 27 stops moving. After this large-diameter piston 27 has stopped moving, the small-diameter piston 28 is pushed by the fluid flowing to the interior of the large-diameter piston 27 and thus moved backward. A moving velocity thereof at this time is, however, higher than a velocity at which this piston 28 moves together with the large-diameter piston 27 because of the pressure receiving area being narrowed. It is therefore possible to reduce a time for pulling out the die. Next, when the small-diameter piston 28 moves up to the backward limit and impinges on the stopper 32, the switching valve is switched over, with the result that both of the front and rear supply/discharge paths 47, 50 are connected to the tank. The supply of the fluid flowing via these two supply/discharge paths 47, 50 is then stopped. Note that when both of the front and rear supply/discharge paths 47, 50 are thus connected to the tank (low pressure), the front and rear opening/closing valves 67, 77 are closed in the same way as the above-mentioned. FIG. 1 illustrates a state at this time.

Figure 4:
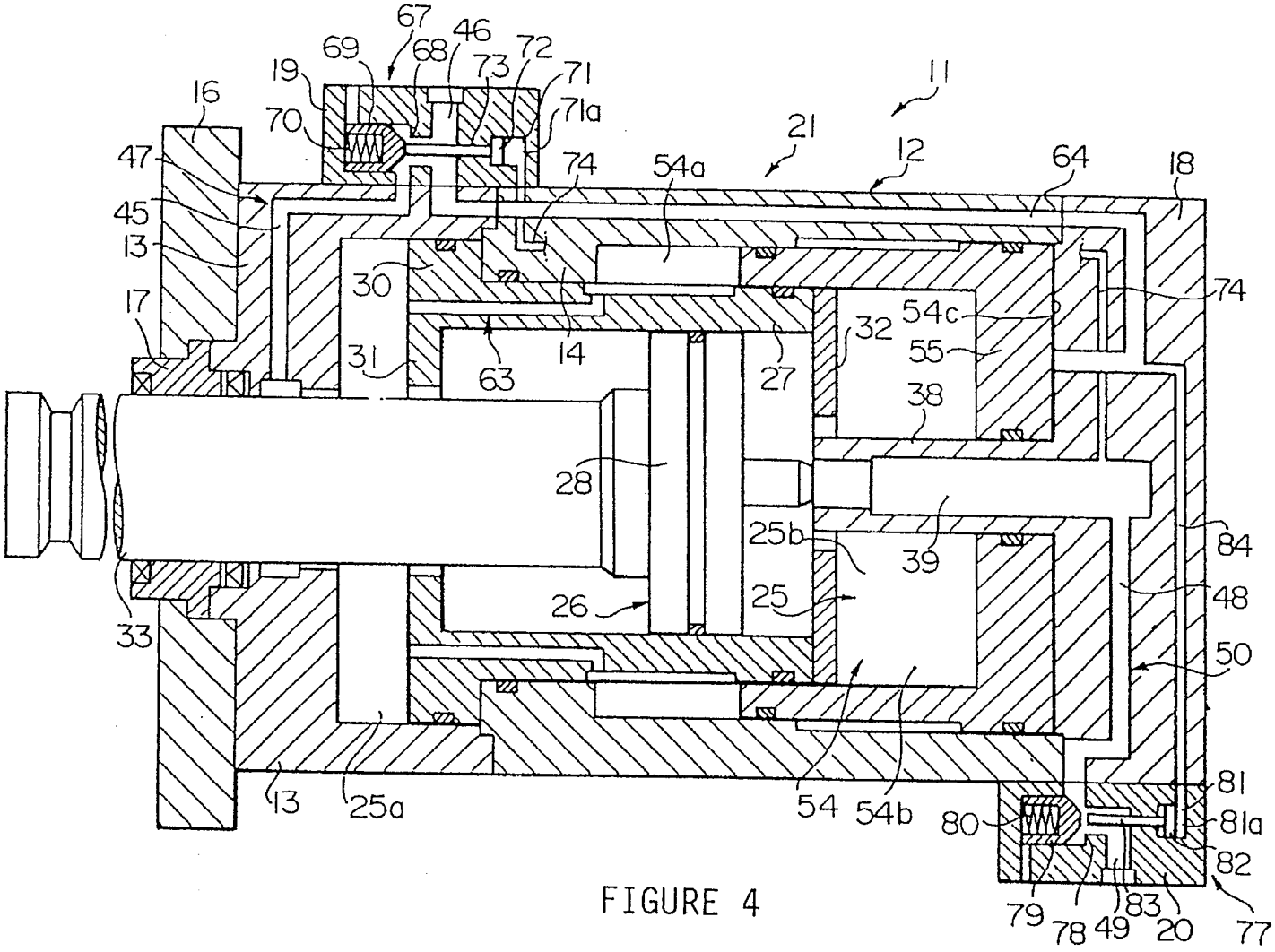
FIG. 4 is a front sectional view, similar to FIG. 1, of assistance in explaining the operating state.

Next, in the case of closing the die, the switching valves are switched over, thereby connecting the front supply/discharge path 47 to the tank and the rear supply/discharge path 50 to the fluid source. In consequence, the fluid from the fluid source is supplied via the rear supply/discharge path 50 and the damper passageway 39 to the rear main cylinder subchamber 25*b* and the second pressure intensifying cylinder subchamber 54*b* while thrusting open the rear opening/closing valve 77. The fluid force acting forward is given to the main piston 26, while the fluid force acting on the other side (backward) is given to the pressure intensifying piston 55. At this time, a load, viz., the die having a weight to some extent is linked to the main piston 26 via the piston rod 33. However, any load is not linked to the pressure intensifying piston 55, and, therefore, the pressure intensifying piston 55 moves to the other side in advance of the main piston 26. Further, at this moment, the fluid from the fluid source flows into the head-side subchamber 71*a* of the pilot cylinder chamber 71 via the front pilot passageway 74 and pushes the pilot piston 72 and the pilot rod 73 forward, thereby opening the front opening/closing valve 67. As a result, the pressure intensifying piston 55 moves on the other side (backward), whereby a part of the fluid flowing into the second connection passageway 64 from the other-side pressure intensifying cylinder subchamber 54*c* then flows into the first pressure intensifying cylinder subchamber 54*a* via the front supply/discharge path 47, the front main cylinder subchamber 25*a* and the first connection passageway 63. The rest of the fluid is discharged to the tank via the front supply/discharge path 47. Subsequently, the pressure intensifying piston 55 moves up to the other-side limit and impinges on the rear cover 18. Thereat, the main piston 26 starts moving forward. At this moment, a contact area between the small-diameter piston 28 and the large-diameter piston 27 is smaller than a contact area between the large-diameter piston 27 and the cylinder casing 21, and hence, as illustrated in FIG. 4, the small-diameter piston 28 moves forward. However, since the pressure receiving area of this small-diameter piston 28 is small, this small-diameter piston 28 moves at a high velocity, and the time for closing the die is reduced. Then, when the small-diameter piston 28 impinges on the stopper 31 of the large-diameter piston 27, the small- and large-diameter pistons 28, 27 thereafter move forward together. At this time, the fluid flowing out of the front main cylinder subchamber 25*a* is discharged to the tank via the front supply/discharge path 47. Subsequently, when the large-diameter piston 27 impinges on the bottom of the first cylinder tube 13, the main piston 26 reaches the forward limit and stops moving. At this time, the front and rear supply/discharge paths 47, 50 are connected to the tank by switching over the switching valves.

As explained above, the second pressure intensifying cylinder subchamber 54*b*, which is not normally employed, is used for moving the pressure intensifying piston 55 toward the other side (backward). This eliminates the necessity for the control valve with the throttle as seen in the prior art and makes it possible to simplify the structure and reduce the manufacturing costs. Further, the pressure intensifying piston 55 is incorporated integrally into the fluid cylinder 11 and can be therefore installed in even a narrow space. Moreover, since the main cylinder chamber 25 and the pressure intensifying cylinder chamber 54 are connected to each other in the interior of the fluid cylinder 11, it does not happen that the high-pressure fluid easily sprouts out, and the safety is ensured.

Note that the main piston 26 is constructed of the large- and small-diameter pistons 27, 28 in the embodiment discussed above. According to the present invention, however, the main piston may be constructed of a single length of piston-as in the case of an ordinary cylinder. Further, in the embodiment discussed above, the front main cylinder subchamber 25*a* is connected through the first connection passageway 63 to the first pressure intensifying cylinder chamber 54*a*, but, according to this invention, they may be directly connected to each other. Moreover, in accordance with the embodiment discussed above, one side of the pressure intensifying piston 55 is conceived as the front side, while the other side thereof is conceived as the rear side. According to this invention, however, one side thereof may be set as the rear side, while the other side thereof may be set as the front side. Further, in the above-described embodiment, the pressure intensifying piston 55 takes the concave shape in section but, according to the present invention, may take a convex shape in section.

As discussed above, according to the present invention, the down-sizing and the reduction in the costs of the fluid cylinder are attained by simplifying the structure thereof, and, at the same time, the safety can be also improved.

It is apparent that, in this invention, a wide range of different working modes can be formed based on the invention without deviating from the spirit and scope of the invention. This invention is not restricted by its specific working modes except being limited by the appended claims.

What is claimed is:

1. A fluid cylinder comprising:

a cylinder casing having its interior formed with a main cylinder chamber and a pressure intensifying cylinder chamber;

a main piston, slidably housed in said main cylinder chamber and provided with a piston rod linked to a load on its front edge side, for sectioning said main cylinder chamber into a front main cylinder subchamber positioned on the front side and a rear main cylinder subchamber positioned on the rear side;

a front supply/discharge path, formed within said cylinder casing, for supplying a fluid to said front main cylinder subchamber;

a rear supply/discharge path, formed within said cylinder casing, for supplying the fluid to said rear main cylinder subchamber; and a pressure intensifying piston, slidably housed in said pressure intensifying cylinder chamber, for sectioning said pressure intensifying cylinder chamber into first and second pressure intensifying cylinder subchambers positioned on one side but shut off from each other in terms of a fluidity and an other-side pressure intensifying cylinder subchamber positioned on the other side, wherein said first pressure intensifying cylinder subchamber is connected to said front main cylinder subchamber, said second pressure intensifying cylinder subchamber is connected to said rear supply/discharge path, said other-side pressure intensifying cylinder subchamber is connected to said front supply/discharge path, a large fluid force acting backward is imparted to said main piston by guiding a high pressure generated in said first pressure intensifying cylinder subchamber to said front main cylinder subchamber with a movement of said pressure intensifying piston toward one side when the fluid is supplied from said front supply/discharge path to said other-side pressure intensifying cylinder subchamber, and said pressure intensifying piston is, on the other hand, moved up to an other-side limit in advance of said main piston when the fluid is supplied from said rear supply/discharge path to said rear main cylinder subchamber and said second pressure intensifying cylinder subchamber.

2. A fluid cylinder according to claim 1, wherein said pressure intensifying piston is constructed of a cylindrical portion and a disc member having its outer periphery integrally linked to the inner periphery of the other edge portion of said cylindrical portion, said first pressure intensifying cylinder subchamber is, at the same time, disposed in a face-to-face position with one edge surface of said cylindrical portion, said second pressure intensifying cylinder subchamber is disposed in a face-to-face position with one edge surface of said disc member, said other-side pressure intensifying cylinder subchamber is disposed in a face-to-face position with the other edge surface of said disc member, and said cylindrical portion is, further, slidably fitted to the outer portion of said main piston.

3. A fluid cylinder according to claim 2, wherein said first pressure intensifying cylinder subchamber is connected to said front main cylinder subchamber by forming a passageway in the interior of said main piston.

4. A fluid cylinder according to claim 1, wherein an opening/closing valve which is, when said rear supply/discharge path or said front supply/discharge path is under a set pressure, opened upon receiving this set pressure but closed when both of said supply/discharge paths are under a low pressure is provided halfway of said rear supply/discharge path, and a movement of said main piston is regulated by locking said rear main cylinder subchamber in terms of a fluidity by said closed opening/closing valve.

* * * * *